US010047640B2

(12) United States Patent
Ludwig et al.

(10) Patent No.: US 10,047,640 B2
(45) Date of Patent: Aug. 14, 2018

(54) ROLLER TAPPET AND METHOD FOR MANUFACTURING A HOUSING ELEMENT OF A ROLLER TAPPET

(71) Applicants: Daniel Ludwig, Gochsheim (DE); Bernd Naujoks, Grafenrheinfeld (DE)

(72) Inventors: Daniel Ludwig, Gochsheim (DE); Bernd Naujoks, Grafenrheinfeld (DE)

(73) Assignee: AKTIEBOLAGET SKF, Gothenburg (SE)

( * ) Notice: Subject to any disclaimer, the term of this patent is extended or adjusted under 35 U.S.C. 154(b) by 0 days.

(21) Appl. No.: 14/861,487

(22) Filed: Sep. 22, 2015

(65) Prior Publication Data

US 2016/0084116 A1 Mar. 24, 2016

(30) Foreign Application Priority Data

Sep. 22, 2014 (DE) ..... 10 2014 218 961

(51) Int. Cl.
*F01L 1/14* (2006.01)

(52) U.S. Cl.
CPC ..... *F01L 1/14* (2013.01); *F01L 2101/00* (2013.01); *F01L 2103/00* (2013.01)

(58) Field of Classification Search
CPC ..... F01L 1/14; F01L 2103/00; F01L 2101/00
USPC ..... 123/90.48, 90.51
See application file for complete search history.

(56) References Cited

U.S. PATENT DOCUMENTS

| | | | |
|---|---|---|---|
| 2012/0012527 | A1 | 1/2012 | Allen et al. |
| 2013/0021333 | A1 | 1/2013 | Tsuchida |

FOREIGN PATENT DOCUMENTS

| | | | |
|---|---|---|---|
| DE | 4331694 | A1 | 3/1995 |
| DE | 69301520 | T2 | 5/1997 |
| DE | 102012202566 | A1 | 8/2013 |
| DE | 102012221604 | A1 | 5/2014 |
| JP | H06159016 | A | 6/1994 |

OTHER PUBLICATIONS

Hauvespre et al., Cam Follower Roller Device, US Patent Application Pub. US 2014/0150602 A1, Jun. 5, 2014.*

* cited by examiner

*Primary Examiner* — Ching Chang
(74) *Attorney, Agent, or Firm* — Bryan Peckjian; SKF USA Inc. Patent Dept.

(57) ABSTRACT

A roller tappet includes a housing, and the housing includes a first housing element and a second housing element. The first housing element has a receiving region configured to receive a roller of the roller tappet, and the second housing element is separate from the first housing element and is forged. The first housing element may be formed from metal sheet.

16 Claims, 2 Drawing Sheets

ROLLER TAPPET AND METHOD FOR MANUFACTURING A HOUSING ELEMENT OF A ROLLER TAPPET

CROSS-REFERENCE

This application claims priority to German patent application no. 10 2014 218 961.6 filed on Sep. 22, 2014, the contents of which are fully incorporated herein by reference.

TECHNOLOGICAL FIELD

The invention relates to a roller tappet having a two-part housing.

BACKGROUND

A roller tappet that includes a one-piece housing made from steel plate is known from DE 10 2012 202 566 A1 (a family member of US 2013/0213333). A roller tappet is also known that includes a one-piece housing formed from a press-forged part.

SUMMARY

One aspect of the disclosure is to provide an improved roller tappet having high efficiency. The roller tappet includes a housing, and the housing includes a first housing element and at least one second housing element.

The at least one second housing element is formed separate from the first housing element. Configured "separate" from the first housing element should be understood to mean that the first housing element forms a first component and the second housing element forms a second component, and that the two components are different from each other. A high efficiency can be achieved using this design. In particular, a cost-effective construction and a simple installability can be achieved. In particular, a simple installability can be achieved in comparison to a design wherein a tappet roller is installed in a one-piece housing.

Preferably the first housing element is one-piece and/or the second housing element is one-piece. "One-piece" should be understood to mean made from one casting and/or not separable without destruction. In this way a constructively simple design can be achieved.

In addition, the first and the second housing element each form at least a significant part of an entire radial-side outer surface of the roller tappet. "Significant part" should in particular be understood to mean at least 5%, preferably at least 15%, and particularly preferably at least 25%. In this way a constructively simple design can be achieved.

The roller tappet is suitable for a high-pressure fuel pump, a valve train of an internal combustion engine, and/or for an axial- or radial-piston engine.

In addition, a method for manufacturing a housing element of the roller tappet is disclosed in which method the housing element is forged, in particular drop-forged. This forged housing element is part of the housing of the roller tappet but does not constitute the entire housing of the roller tappet. In this way a high efficiency can be achieved. A housing part or element can be manufactured entirely by forging or drop-forging, and this may allow further machining (or other material removal processes) that might follow a forging process to be omitted. The housing part can be, for example, a component that is configured to actuate a piston and/or a tappet. Under certain circumstances the housing part can include a base for this purpose, which, in the axial direction, forms an abutment surface for a tappet or a piston. Under certain circumstances an additional housing part that forms the rest of the overall housing of the roller tappet can be disposed so that it does not directly contact the piston or the tappet.

Additionally or alternatively the additional housing part can be manufactured using a manufacturing process other than forging. For example, the additional housing element can be manufactured from metal plate. Thus in some exemplary embodiments, a weight of the tappet can be reduced and/or a manufacturing can be simplified because one of the housing elements (referred to hereinafter as the first housing element) is formed in a manner other than by forging, from metal plate, for example, while the other housing element (referred to hereinafter as the second housing element) is forged.

Further advantages will become apparent from the following drawing description. An exemplary embodiment of the invention is depicted in the drawings. The drawings, the description, and the claims contain numerous features in combination. The person skilled in the art will also advantageously consider the features individually and combine them into further meaningful combinations.

DETAILED DESCRIPTION

Figure 1:
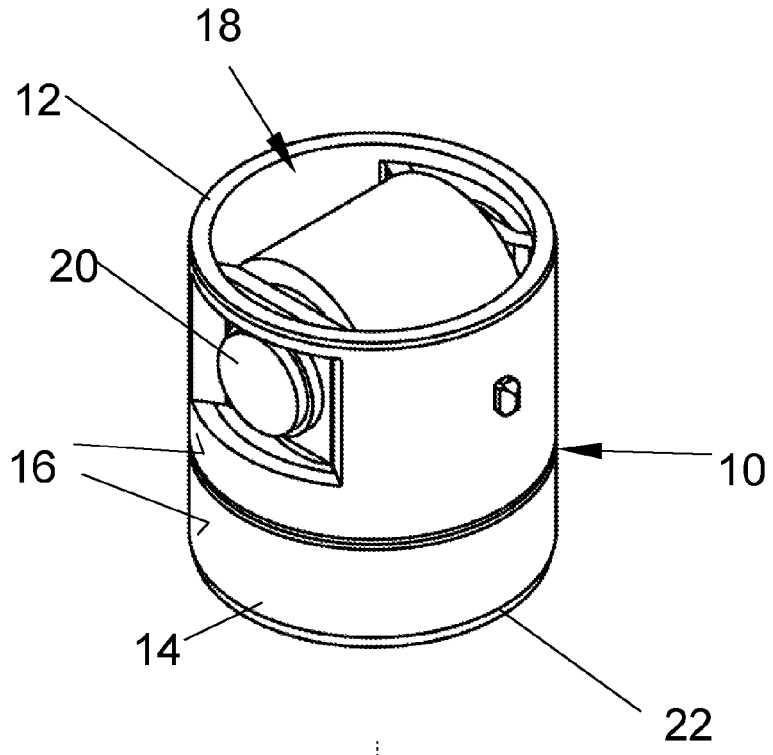
FIG. 1 is a perspective view of a roller tappet according to the present disclosure.

FIG. 1 shows a perspective view of a roller tappet according to the present disclosure that includes a housing 10. The housing 10 comprises a first housing element 12 and a second housing element 14 that is attached to the first housing element 12 by laser welding. Alternatively the second housing element 14 could be press-fitted into the first housing element 12. The first and the second housing elements 12, 14 are each one-piece elements. Furthermore, the first housing element 12 is formed from steel plate, and the second housing element 14 is manufactured by forging or drop-forging.

Figure 2:
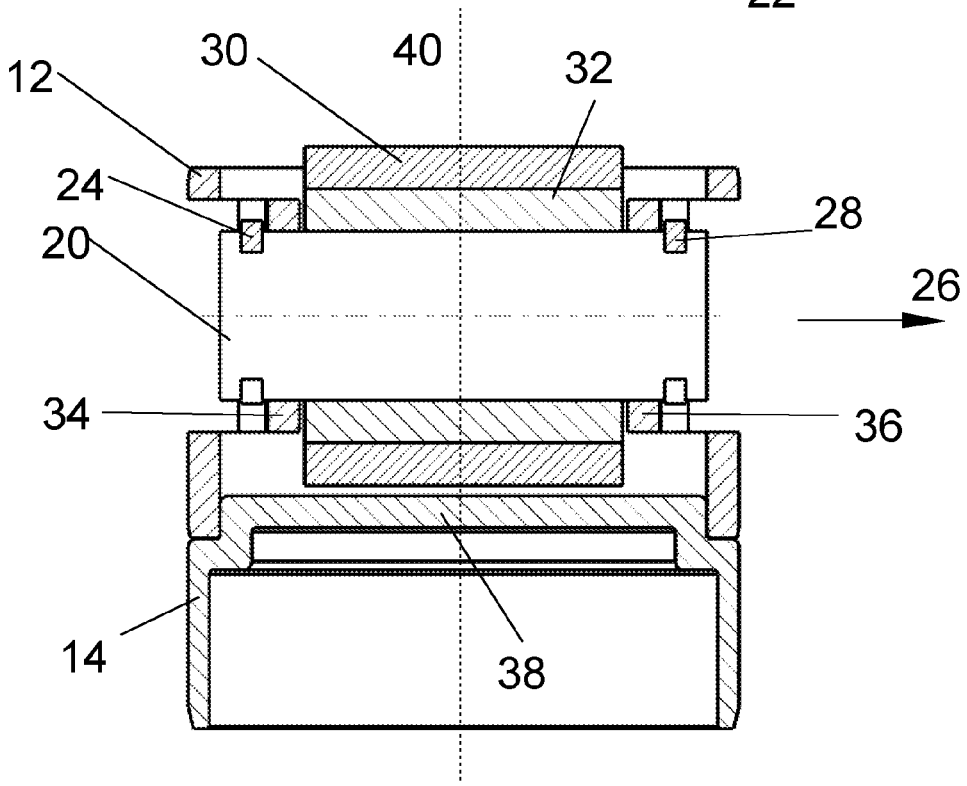
FIG. 2 is a partial section along a longitudinal direction of the roller tappet of FIG. 1 and along a longitudinal direction of a roller of the roller tappet of FIG. 1.

The housing 10 includes an outer surface 16 substantially in the shape of a circular-cylindrical shell having openings. An axis of symmetry 40 of the circular-cylindrical shell is parallel to an axial direction of the roller tappet (FIG. 2). The surface 16 is an entire surface of the housing 10, that is, it comprises the outer surface of the first housing element 12 and the outer surface of the second housing element 14. The surface 16 is external with respect to the radial directions to the axis of symmetry 40. The outer surfaces of the first housing element 12 and the second housing element 14 each form more than 10% of the surface 16.

Furthermore, the first housing element 12 comprises a receiving region 18 in which a roller 20 of the roller tappet is disposed. The second housing element 14 forms an axial end region 22 of the roller tappet, and a base 38 of the roller tappet is a part of the second housing element 14. In some exemplary embodiments the base 38 serves as a contact surface or abutment surface for a tappet or a piston (not illustrated). The base 38 may completely close the second housing part 14 in the axial direction.

The second housing element 14 includes an open end that faces axially away from the base 38 and is disposed with respect to the first housing element 12 so that the open end faces axially away from the first housing element 12. The base 38 at least sectionally or even fully overlaps with the first housing part 12 in the axial direction 40.

Figure 3:
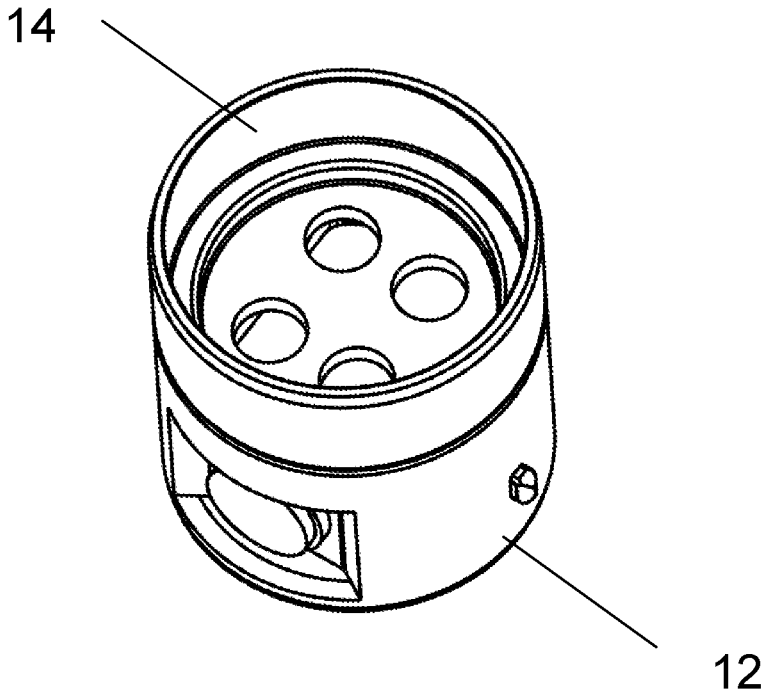
FIG. 3 is a bottom perspective view of the roller tappet of FIG. 1
Figure 4:
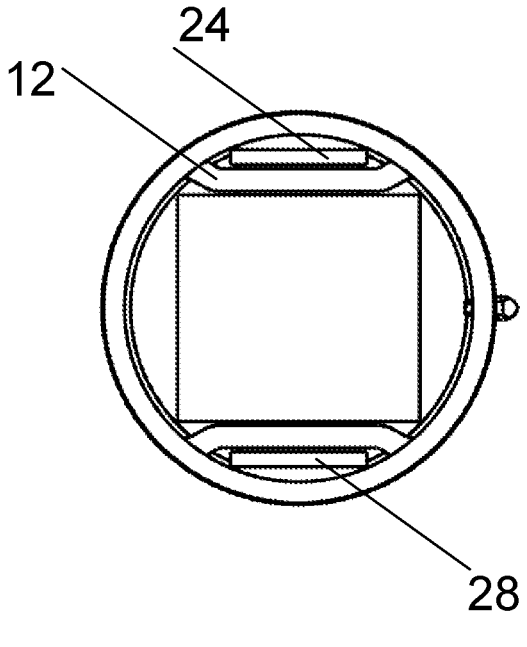
FIG. 4 is a bottom plan view of the roller tappet of FIG. 1.

In the exemplary embodiment of FIG. 3 the base includes four openings.

The roller of the roller tappet abuts on a first annular region 34 and a second annular region 36 of the first housing element 12. First and a second clip rings 24, 28 each engage in a groove of the roller and thus attach the roller in an interference-fit manner with respect to an axial direction 26 of the roller. The roller has a circular-cylindrical shape. The grooves extend on a radial outer side of the roller along a circumferential direction of the roller. Bushings 30, 32 of the roller tappet are rotatably supported relative to the roller. In principle the bushing 30 can also be rotatably supported with respect to the roller by a rolling-element bearing, such as, for example, needle roller bearings.

If the roller tappet is built into a high-pressure fuel pump, then the bushing 30 comes into contact with a cam, and the second housing element contacts a pump piston. In other exemplary embodiments the second housing element can also be used in other devices, for example an engine, and be in contact with a piston and/or a tappet.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved roller tappets and methods.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter

REFERENCE NUMBER LIST

10 Housing
12 Housing element
14 Housing element
16 Surface
18 Receiving region
20 Roller
22 End region
24 Clip ring
26 Direction
28 Clip ring
30 Bushing
32 Bushing
34 Region
36 Region
38 Base
40 Axis of symmetry

What is claimed is:

1. A roller tappet including a housing, the housing including a first housing element and a second housing element, the first housing element including a receiving region configured to receive a roller of the roller tappet, the roller having first and second roller axial ends, the first housing element having a first annular region defining a first bore therethrough, the first housing element having a second annular region defining a second bore therethrough, the first and second bores being configured for the roller to be inserted therethrough such that the roller is supported by the first and second annular regions of the first housing, the roller being located in the receiving region and extending through the first and second annular regions such that the first and second roller axial ends are located outside of the first housing, the second housing element is separate from the first housing element and is forged.

2. The roller tappet according to claim 1, wherein the first housing element is one-piece or the second housing element is one-piece or both the first housing element and the second housing element are one-piece.

3. The roller tappet according to claim 1, wherein the first housing element is made from metal plate.

4. The roller tappet according to claim 3, wherein the first housing element is connected to the second housing element by a weld.

5. The roller tappet according to claim 1, wherein the second housing element is drop forged.

6. The roller tappet according to claim 1, wherein the first housing element and the second housing element each form at least 5% of an entire radial-side outer surface of the roller tappet.

7. The roller tappet according to claim 1, wherein the first housing element and the second housing element each form at least 10% of an entire radial-side outer surface of the roller tappet.

8. The roller tappet according to claim 1, wherein the first housing element and the second housing element each form at least 25% of an entire radial-side outer surface of the roller tappet.

9. The roller tappet according to claim 1, including at least one roller of the roller tappet disposed in the receiving region and wherein the second housing element forms an axial end region of the roller tappet.

10. The roller tappet according to claim 9, including a first clip ring securing the roller of the roller tappet against movements in a first direction relative to the first housing element.

11. The roller tappet according to claim 1, wherein the first housing element and the second housing element are connected to each other in a materially bonded or friction-fit manner.

12. The roller tappet according to claim 11, wherein the first housing element forms at least 10% of an outer cylindrical wall of the roller tappet and the second housing element forms at least 10% of the outer cylindrical wall of the roller tappet.

13. The roller tappet according to claim 11, wherein the first housing element forms at least 25% of an outer cylindrical wall of the roller tappet and the second housing element forms at least 25% of the outer cylindrical wall of the roller tappet.

14. The roller tappet according to claim 1, including at least one roller of the roller tapped disposed in the receiving region, and wherein the first housing element is one-piece or the second housing element is one-piece or both the first housing element and the second housing element are one-piece, wherein the first housing element is made from metal plate, wherein the second housing element is drop forged, wherein the first housing element and the second housing element each form at least 25% of an entire radial-side outer surface of the roller tappet, wherein the second housing element forms an axial end region of the roller tappet, wherein the first housing element and the second housing element are connected to each other in a materially bonded or friction-fit manner, and including a first clip ring securing the roller of the roller tappet against movements in a first direction relative to the first housing element.

15. The roller tappet according to claim 1, wherein the first housing element is connected to the second housing element by a weld.

16. The roller tappet according to claim 1, wherein the second housing element includes an axially facing cylindrical opening configured to receive a piston, and wherein the first housing element is not forged, and the first housing element is connected to the second housing element by a weld and wherein the first housing element and the second housing element each form at least 10% of an entire radial-side outer surface of the roller tappet.

* * * * *